US008136662B2

(12) United States Patent
Aeschlimann

(10) Patent No.: US 8,136,662 B2
(45) Date of Patent: Mar. 20, 2012

(54) HINGE-LID CONTAINER WITH ADDITIONAL SPACER PANEL

(75) Inventor: Reynald Aeschlimann, Corcelles (CH)

(73) Assignee: Philip Morris USA Inc., Richmond, VA (US)

( * ) Notice: Subject to any disclaimer, the term of this patent is extended or adjusted under 35 U.S.C. 154(b) by 570 days.

(21) Appl. No.: 11/792,509

(22) PCT Filed: Dec. 7, 2005

(86) PCT No.: PCT/IB2005/004002

§ 371 (c)(1),
(2), (4) Date: Jul. 16, 2007

(87) PCT Pub. No.: WO2006/061718

PCT Pub. Date: Jun. 15, 2006

(65) Prior Publication Data

US 2007/0272568 A1 Nov. 29, 2007

(30) Foreign Application Priority Data

Dec. 8, 2004 (EP) ..... 04257628

(51) Int. Cl.
*B65D 85/10* (2006.01)
*B65D 5/34* (2006.01)

(52) U.S. Cl. ..... 206/268; 206/273; 206/265

(58) Field of Classification Search ..... 206/264, 206/242, 265, 268, 271, 273; 229/87, 13, 229/160.1

See application file for complete search history.

(56) References Cited

U.S. PATENT DOCUMENTS

| | | | | |
|---|---|---|---|---|
| 4,447,003 | A * | 5/1984 | Gray | 229/146 |
| 4,729,508 | A * | 3/1988 | Erdmann et al. | 229/146 |
| 4,948,038 | A * | 8/1990 | Moeller | 229/146 |
| 5,160,024 | A * | 11/1992 | Evers | 206/268 |
| 5,277,304 | A | 1/1994 | Brizzi et al. | |
| 5,651,454 | A * | 7/1997 | Trimani | 206/273 |
| 6,199,688 | B1 | 3/2001 | Focke | |
| 7,438,183 | B2 * | 10/2008 | Focke et al. | 206/268 |
| 7,455,177 | B2 * | 11/2008 | Serafini et al. | 206/268 |
| 2006/0157357 | A1 * | 7/2006 | Serafini et al. | 206/268 |

FOREIGN PATENT DOCUMENTS

| | | |
|---|---|---|
| DE | 9103760 | 10/1993 |
| DE | 20312804 | 10/2003 |
| DE | 10239681 | 3/2004 |
| EP | 0392737 | 10/1990 |
| WO | WO 2004074123 A1 * | 9/2004 |

* cited by examiner

*Primary Examiner* — Steven A. Reynolds
(74) *Attorney, Agent, or Firm* — Buchanan Ingersoll & Rooney PC

(57) ABSTRACT

A hinge-lid container finding particular application as a hinge-lid pack or carton for elongate smoking articles such as cigarettes, which includes a box portion; a lid portion hinged to the box portion across a rear wall thereof for pivotal movement between an pen position and a closed position; a flap extending across a lower part of the inner surface of a front wall of the lid portion; and a spacer panel extending across at least an upper part of the inner surface of a front wall of the box portion. The spacer panel, which preferably depends from and is folded about the upper edge of the front wall of the box portion, has a free edge that extends across the inner surface of the front wall of the box portion and does not project from the box portion into space covered by the lid portion in the closed position.

17 Claims, 4 Drawing Sheets

HINGE-LID CONTAINER WITH ADDITIONAL SPACER PANEL

This application is a national stage application under 35 USC §371 of International Application Number PCT/IB2005/004002, filed Dec. 7, 2005, the international Application being published in English and the contents of which is hereby incorporated by reference. This application also claims priority under 35 USC §119 to European Application No. 04257628.0, filed Dec. 8, 2004.

FIELD OF THE INVENTION

The present invention relates to a novel hinge-lid container and in particular to a novel hinge-lid pack or carton for elongate smoking articles such as cigarettes.

BACKGROUND

Cigarettes are commonly sold in hinge-lid cardboard packs having a box portion and a lid portion, which is hinged to the rear wall of the box portion. In use, with the pack in an upright position, the front of the lid portion is pivoted up and to the rear by the consumer to open the pack and thereby allow access to a bundle of cigarettes standing in the box portion. When the lid portion is closed, the front, side and rear walls of the lid portion form vertical extensions of the corresponding walls of the box portion.

Hinge-lid cigarette packs normally also include an inner frame or collar mounted inside the front and sides of the box portion, at least a portion of which projects from the box portion into the space covered by the lid portion in the closed position. A central cut-out is provided in the front wall of the inner frame to allow the consumer to readily remove cigarettes from the hinge-lid pack in the open position. In use, the inner frame provides interference or frictional engagement with the lid portion as it opens and closes, thereby helping to prevent accidental opening of the pack and helping to retain the lid portion in the closed position when desired. In addition, the inner frame also serves to reinforce the box portion of the hinge-lid pack.

Typically, the box portion and the lid portion of the hinge-lid cigarette pack are formed from a single, folded, laminar cardboard blank and the inner frame is formed from a second, separate, laminar cardboard blank. To produce the pack, a bundle of cigarettes wrapped in, for example, metallised paper or aluminium foil is placed together with the second laminar cardboard blank in a pocket on a wrapping wheel, which is lined with the first laminar cardboard blank. The wrapping wheel is indexable between a number of stations and as the pocket indexes around from station to station, the first laminar cardboard blank is folded in stages around the wrapped bundle of cigarettes and inner frame to form the hinge-lid pack. Typically, the formed hinge-lid cigarette pack is then shrink wrapped or otherwise over wrapped with a transparent polymeric film of, for example, polyethylene or polypropylene.

Hinge-lid containers with an integral inner frame, which are formed from a single, folded, laminar cardboard blank are also known. The blanks for such containers can be complicated and, in order to erect the container, require reverse folding that is difficult to achieve using conventional machinery.

Laminar cardboard blanks from which hinge-lid cigarette packs and other hinge-lid containers are formed often include an inner lid panel that extends from the panel of the blank which, in use, forms the front wall of the lid portion of the pack. During production, this inner lid panel is folded through 180 degrees and affixed to the inner surface of the lid front wall panel of the blank so that in the formed hinge-lid container it rests against the inside of the front wall of the lid portion thereof. As well as providing reinforcement to the lid portion of the formed hinge-lid container, the inner lid panel may be provided with retention means that, in use, cooperate with portions of an inner frame mounted in the container to retain the lid portion thereof in a completely closed position, with the lower edges of the lid portion abutting the upper edges of the box portion. In addition, the outer surface of the inner lid panel may be advantageously printed with consumer information. The fold line formed between the inner lid panel and the lid front wall panel also advantageously provides a neat, dull lower front edge to the lid portion of the formed hinge-lid container.

In spite of the benefits discussed in the preceding paragraph, the inclusion of an inner lid flap in hinge-lid cigarette packs and other hinge-lid containers disadvantageously results in the lower region of the front wall of the lid portion of the container being of increased thickness compared to the upper region of the front wall of the box portion thereof. Due to the presence of the reinforcing flap, the bottom edge of the front wall of the lid portion is twice the thickness of the top edge of the front wall of the box portion against which it abuts when in the closed position. Such a thickness differential across the lid line is undesirable as the misalignment between the front wall of the lid portion and the front wall of the box portion can give rise to creases or wrinkles in polymeric film over wrappers subsequently applied to the formed hinge-lid container; as well as being unsightly, creases or wrinkles formed in the polymeric film may interfere with subsequent manufacturing and transport operations involving the over wrapped hinge-lid container.

SUMMARY

According to the present invention there is provided a hinge-lid container comprising: a box portion; a lid portion hinged to the box portion across a rear wall thereof for pivotal movement between an open position and a closed position; a flap extending across a lower part of the inner surface of a front wall of the lid portion; and a spacer panel extending across at least an upper part of the inner surface of a front wall of the box portion, the spacer panel having a free edge that extends across the inner surface of the front wall of the box portion, wherein the spacer panel does not project from the box portion into space covered by the lid portion in the closed position.

The inclusion of a spacer panel adjacent the inner surface of the front wall of the box portion spaces the upper part of the front wall of the box portion from the contents thereof. As it does not project into the space covered by the lid portion in the closed position, the spacer panel thereby compensates for the increased thickness of the lower part of the inner surface of the front wall of the lid portion due to the flap. By reducing or eliminating any thickness differential across the lid line of hinge-lid containers according to the invention, the spacer panel advantageously avoids misalignment between the front wall of the lid portion and the front wall of the box portion thereof that could result in creases or wrinkles in an over wrappers subsequently applied to the container.

The spacer panel also advantageously reinforces the box portion of hinge-lid containers according to the invention. Consequently, hinge-lid containers according to the invention having substantially the same rigidity as known hinge-lid containers may be advantageously formed from reduced thickness laminar cardboard blanks or other materials and/or without the need for inclusion of an inner frame.

Preferably, the spacer panel is of substantially the same thickness as the flap.

Preferably, the spacer panel has a free edge that extends across the inner surface of the front wall of the box portion substantially parallel to the upper edge of the front wall of the box portion.

The flap preferably depends from and is folded about the upper edge of the front wall of the lid portion. The flap may be affixed to the inner surface of the front wall of the lid portion using, for example, an adhesive. The spacer panel may be affixed to the inner surface of the front wall of the box portion using, for example, an adhesive.

In a preferred embodiment of the invention, the spacer panel is integral with the front wall of the box portion. More preferably, the spacer panel depends from and is folded about the upper edge of the front wall of the box portion.

Preferably, the box portion, lid portion, flap and spacer panel are formed from a one-piece folded laminar blank.

In other embodiments of the invention, the spacer panel may be a separate panel that is, for example, adhered with a suitable adhesive or otherwise affixed to the inner surface of the front wall of the box portion. In such embodiments, the spacer panel has a pair of opposed free edges that extend across the inner surface of the front wall of the box portion.

Hinge-lid containers according to the invention may further comprise a separate, non-integral inner frame mounted in the box portion and projecting from the box portion into space covered by the lid portion in the closed position. In such embodiments, the spacer panel is positioned between the inner surface of the front wall of the box portion and the inner frame. Where hinge-lid containers according to the invention comprise an inner frame, the spacer panel may be integral with the inner frame as shown in FIG. 4. For example, the spacer panel may depend from and be folded about the lower edge of the front wall of the inner frame so that the spacer panel has a free edge that extends across the inner surface of the front wall of the box portion proximate the upper edge thereof. The box portion, lid portion and flap may be formed from a first, folded, one-piece laminar blank and the inner frame and spacer panel formed from a second, folded, one-piece laminar blank.

Where hinge-lid containers according to the invention comprise an inner frame, the spacer panel may alternatively be a separate panel that is adhered or otherwise affixed to the outer surface of the lower part of the inner frame, which is mounted in the box portion of the hinge-lid container. The spacer panel may be the same or a different size to the part of the lower part of the inner frame, which is mounted in the box portion. Furthermore, where the spacer panel is not integral with the inner frame, the spacer panel and the inner frame may be of different thickness and/or formed from different material.

The spacer panel may be of substantially the same dimensions as the front wall of the box portion. This is particularly preferred in embodiments where, as described below, the hinge-lid container according to the invention comprises a first opening extending through the front wall of the box portion and a second opening extending through the spacer panel. To reduce the quantity of cardboard or other material required to produce hinge-lid containers according to the invention, the spacer panel may, however, be of reduced dimensions compared to the front wall of the box portion. For example, the spacer panel may be of substantially the same dimensions as the flap. Preferably, the spacer panel extends across at least a central portion of the upper part of the inner surface of the front wall of the box portion. More preferably, the spacer panel extends across substantially the entire width of the inner surface of a front wall of the box portion.

To allow a consumer to view, for example, the contents of the hinge-lid container or logos or other indicia provided on the inner frame or the outer surface of an inner wrapper in which the contents of the hinge-lid container are wrapped, hinge-lid containers according to the invention may further comprise: a first opening extending through the front wall of the box portion; and a second opening extending through the spacer panel, at least a portion of the second opening being aligned with at least a portion of the first opening.

Where hinge-lid containers according to the invention include an inner frame, they may further comprise a third opening extending through the inner frame, at least a portion of the third opening being aligned with at least a portion of the first opening and with at least a portion of the second opening in order to allow a consumer to view the contents of the container or logos or other indicia provided on the outer surface of an inner wrapper in which the contents of the container are wrapped.

The first opening, second opening and third openings may be of the same or different size and shape. For example, through an appropriate choice of the relative dimensions of the first opening and the second opening, the second opening provided in the spacer panel of hinge-lid containers according to the invention may advantageously be used to provide relief or depth to the first opening provided in the front wall of the box portion thereof.

Hinge-lid containers according to the present invention may be particularly advantageously employed as packs for elongate smoking articles such as cigarettes and/or as cartons for holding a plurality of packs of elongate smoking articles such as cigarettes. For example, through an appropriate choice of the dimensions thereof, hinge-lid containers according to the invention for housing different numbers of conventional size, king size, super-king size, slim or super-slim cigarettes may be produced.

A hinge-lid container according to a preferred embodiment of the invention comprises: a box portion; a lid portion hinged to the box portion across a rear wall thereof for pivotal movement between an open position in which the lower edge of a front wall of the lid portion is spaced apart from the upper edge of a front wall of the box portion; a flap extending across a lower part of the inner surface of the front wall of the lid portion, the flap depending from and being folded about a hinge-line forming the lower edge of the front wall of the lid portion, and a spacer panel extending across the inner surface of the front wall of the box portion, the spacer panel depending from and being folded about a hinge-line forming the upper edge of the front wall of the box portion, wherein the spacer panel does not project from the box portion into space covered by the lid portion in the closed position.

BRIEF DESCRIPTION OF THE DRAWINGS

The invention will be further described, by way of example only, with reference to the accompanying drawings in which.

DETAILED DESCRIPTION

Figure 1:
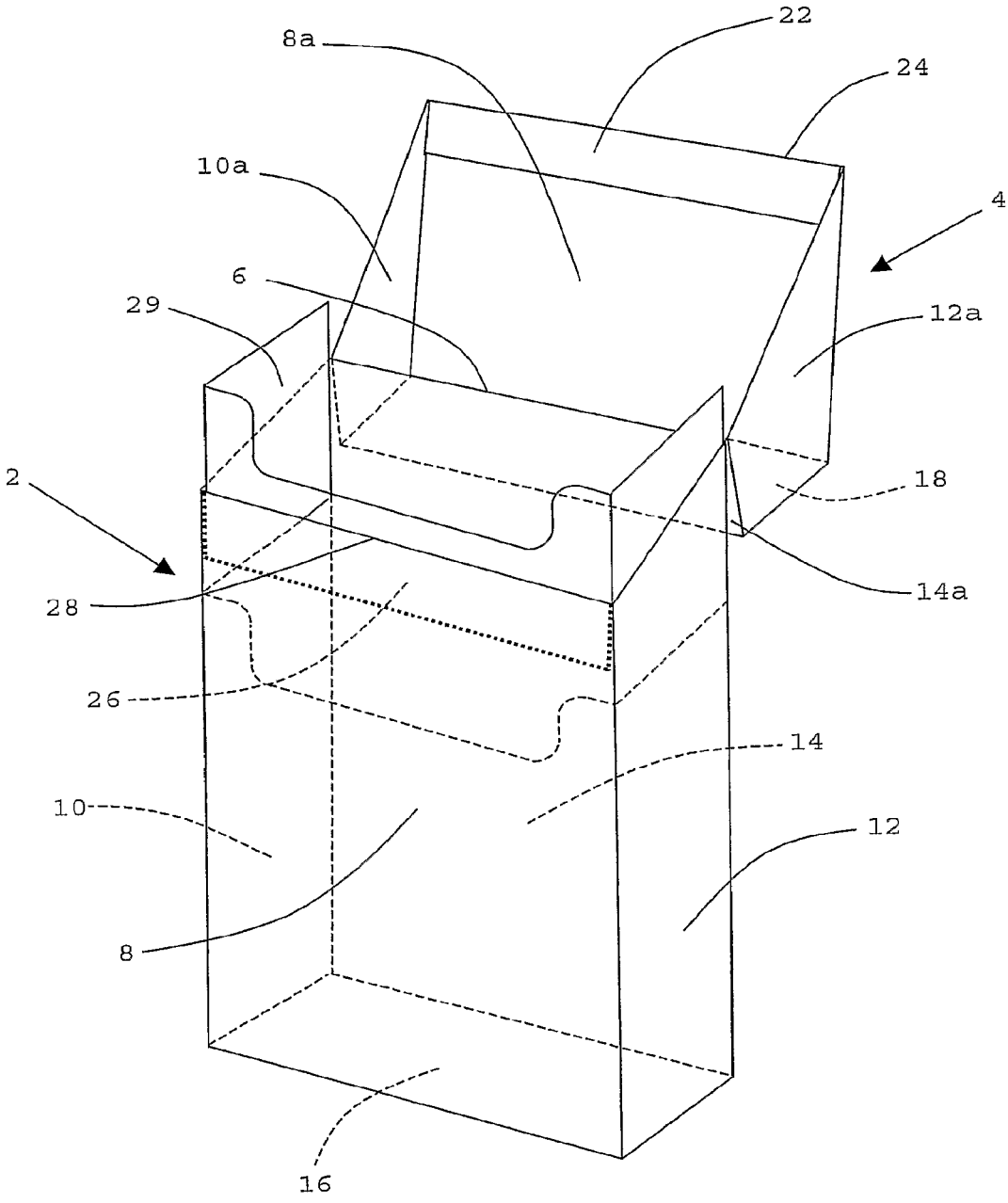
FIG. 1 is a front perspective view of an open hinge-lid container according to a first embodiment of the invention.

The hinge-lid container shown in FIG. 1 is of largely the same construction as a conventional hinge-lid cigarette pack with right-angled vertical edges and comprises a lower box portion 2 and an integral upper lid portion 4, which is hinged to the lower box portion along a hinge line 6. The lower box portion 2 and upper lid portion 4 are formed from a single, folded, one-piece, laminar cardboard blank.

The lower box portion 2 has a front wall 8, a left side wall 10, a right side wall 12, a rear wall 14, and a bottom wall 16. The lid portion 4 similarly has a front wall 8*a*, left side wall 10*a*, right side wall 12*a*, and a rear wall 14*a*, which function respectively as continuations of the similarly numbered walls of the lower box portion 2 when the box portion 2 and lid portion 4 are pivoted about the hinge line 6 from the open position shown in FIG. 1 to a closed position. The upper lid portion 4 of the container additionally includes a top wall 18.

A first flap 22, which is adjacent and parallel to the inner surface of the front wall 8*a* of the lid portion 4, extends from the lower edge 24 of the front wall 8*a* of the lid portion 4 and a second flap 26 (shown in heavy dotted lines in FIG. 1), which is adjacent and parallel to the inner surface of the front wall 8 of the box portion 2, extends from the upper edge 28 of the front wall 8 of the box portion 2.

The hinge-lid container further comprises an inner frame 29 formed from a second, folded, one-piece, laminar cardboard blank, which is mounted in the lower box portion 2 and extends upwardly there from into space covered by the upper lid portion 4 when the upper lid portion 4 is pivoted about the hinge line 6 from the open position shown in FIG. 1 to the closed position. The inner frame 29 has a front wall, a left side wall and a right side wall, the lower portions of which oppose the corresponding walls of the lower box portion 2. As shown in FIG. 1, the second flap 26 is adjacent and parallel to the outer surface of the front wall of the inner frame 29 and is situated between the inner frame 29 and the inner surface of the front wall 8 of the box portion.

Figure 2:
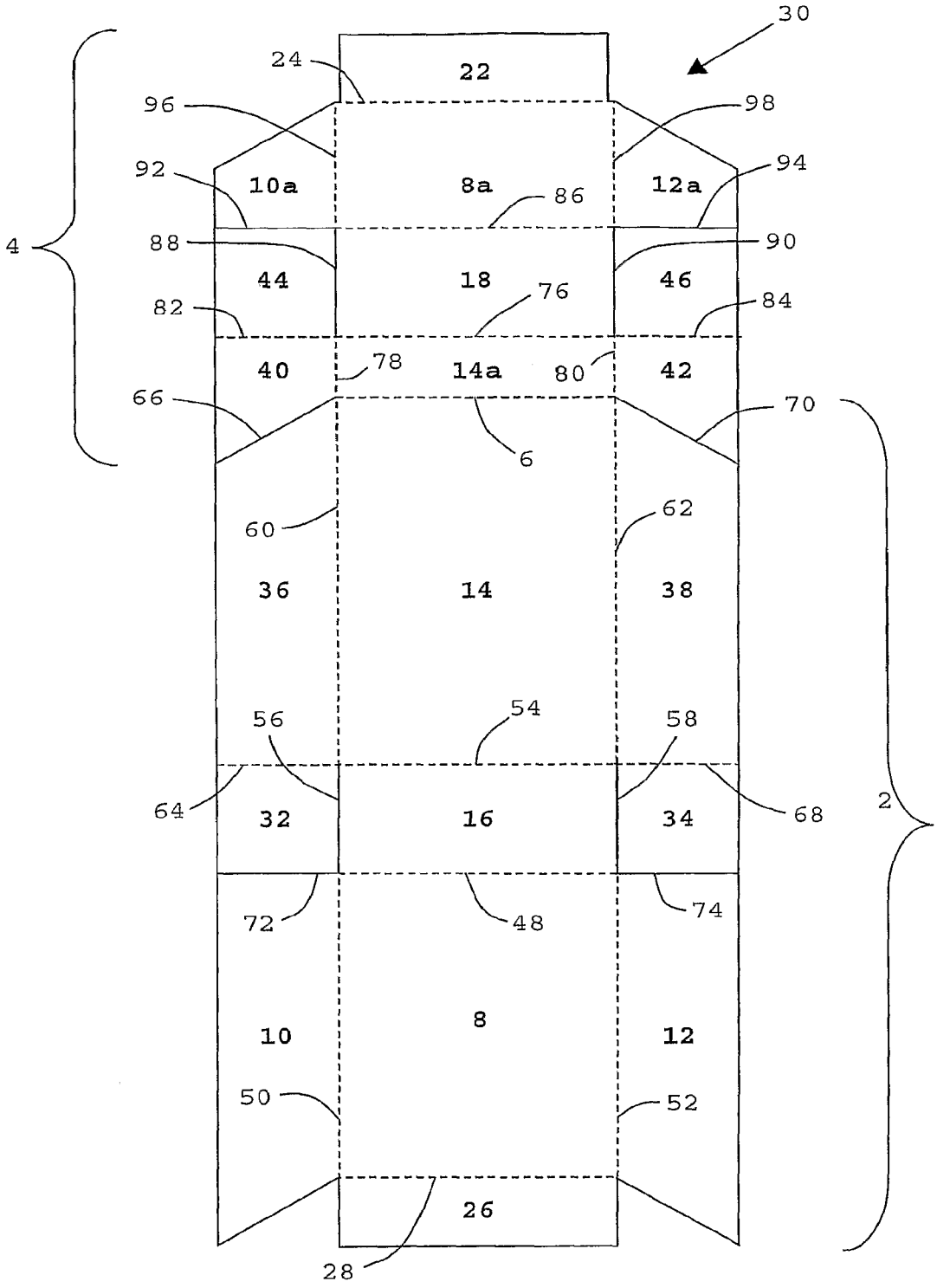
FIG. 2 is a plan view of the inner face of a laminar one-piece blank for forming the lower box portion and upper lid portion of the container of FIG. 1.

An elongate, laminar cardboard blank 30 from which the lower box portion 2 and upper lid portion of the hinge-lid container of FIG. 1 may be formed is shown in FIG. 2. The blank 30 includes various panels and flaps, which when folded about appropriate score lines (shown by broken lines in FIG. 2) form the lower box portion 2 and upper lid portion of the hinge-lid container shown in FIG. 1; the same reference numerals are used in FIG. 2 for elements of blank 30 that are similar or related to elements of the container of FIG. 1 previously described.

The blank 30 includes a box portion flap 26, a box portion front wall panel 8, a box portion outside left side wall panel 10 and a box portion outside right side wall panel 12, a box portion bottom wall panel 16, a box portion left flap 32 and a box portion right flap 34, a box portion rear wall panel 14, a box portion inside left wall panel 36 and a box portion inside right side wall panel 38, a lid portion rear wall panel 14*a*, a lid portion inside left side wall panel 40 and a lid portion inside right side wall panel 42, a lid portion top wall panel 18, a lid portion left flap 44 and a lid portion right flap 46, a lid portion front wall panel 8*a*, a lid portion outside left side wall panel 10*a* and a lid portion outside right side wall panel 12*a*, and a lid portion flap 22.

The box portion front wall panel 8 is defined in the longitudinal direction of the blank 30 by the separation between a first transverse score line 28 and a parallel second transverse score line 48 and in the lateral direction of the blank 30 by the separation between a first longitudinal score line 50 and a parallel second longitudinal score 52, which extend between the first transverse score line 28 and the second transverse score line 48 and are perpendicular thereto. The box portion outside left side wall panel 10 and the box portion outside right side wall panel 12 are connected to the box portion front wall panel 8 along the first longitudinal score line 50 and the second longitudinal score 52, respectively.

The box portion flap 26 extends longitudinally from the box portion front wall panel 8 at the first transverse score line 28. The box portion bottom wall panel 16 extends longitudinally from the box portion front wall panel 8 at the second transverse score line 48 to a parallel third transverse score line 54. The box portion bottom wall panel 16 is further defined in the lateral direction of the blank 30 by the separation between a longitudinal first cut 56 and a parallel longitudinal second cut 58, which extend between the second transverse score line 48 and the third transverse score line 54 and are perpendicular thereto, the longitudinal first cut 56 being a collinear extension of the first longitudinal score line 50 and the longitudinal second cut 58 being a collinear extension of the second longitudinal score line 52.

The box portion rear wall panel 14 extends longitudinally from the box portion bottom wall panel 16 at the third transverse score line 54 to a parallel transverse hinge line 6 and is further defined in the lateral direction of the blank 30 by the separation between a third longitudinal score line 60 and a parallel fourth longitudinal score line 62, which extend between the third transverse score line 54 and the transverse hinge line 6 and are perpendicular thereto, the third longitudinal score line 60 being a collinear extension of the first longitudinal cut 56 and the fourth longitudinal score line 62 being a collinear extension of the second longitudinal cut 58. The transverse hinge line 6 is defined by weakening the cardboard or other material from which the blank 30 is made by any suitable process such as, for example, scoring, creasing and/or embossing. The distance between the third transverse score line 54 and the transverse hinge line 6 is greater than the separation between the first transverse score line 28 and the second transverse score line 48 so that the longitudinal extent of the box portion rear wall panel 14 is greater than that of the box portion front wall panel 8.

The box portion inside left side wall panel 36 and the box portion inside right side wall panel 38 are connected to the box portion rear wall panel 14 along the third longitudinal score line 60 and the fourth longitudinal score line 62, respectively. The box portion inside left side wall panel 36 is of substantially the same shape and size as the box portion outside left side wall panel 10 and is defined in the longitudinal direction of the blank 30 by the separation between a fourth transverse score line 64, which is a substantially collinear extension of the third transverse score line 54, and an angled third cut 66. The box portion inside right side wall panel 38 is of substantially the same shape and size as the box portion outside right side wall panel 12 and is defined in the longitudinal direction of the blank 30 by the separation between a fifth transverse score line 68, which is also a substantially collinear extension of the third transverse score line 54, and an angled fourth cut 70. To facilitate folding of the blank 30, the fourth transverse score line 64 and the fifth transverse score line 68 are longitudinally offset relative to the third transverse score line 54, in the direction of the transverse hinge line 6, by a distance approximately equal to the thickness of the blank 30.

The box portion left flap 32 is connected to the box portion inside left side wall panel 36 along the fourth transverse score line 64 and extends in the longitudinal direction of the blank 30 from the fourth transverse score line 64 to a transverse fifth cut 72, which is a collinear extension of the second transverse score line 48. The box portion right flap 34 is connected to the box portion inside right side wall panel 38 along the fifth transverse score line 68 and extends in the longitudinal direction of the blank 30 from the fifth transverse score line 64 to a transverse sixth cut 74, which is also a collinear extension of the second transverse score line 48.

The lid portion rear wall panel 14*a* extends in the longitudinal direction of the blank 30 from the box portion rear wall panel 14 at the transverse hinge line 6 to a parallel sixth transverse score line 76 and is further defined in the lateral direction of the blank 30 by the separation between a fifth longitudinal score line 78 and a parallel sixth longitudinal score lines 80, which extend between the transverse hinge line 6 and the sixth transverse score line 76 and are perpendicular thereto, the fifth longitudinal score line 78 being a collinear extension of the third longitudinal score line 60 and the sixth longitudinal score line 80 being a collinear extension of the fourth longitudinal score line 62.

The lid portion inside left side wall panel 40 and the lid portion inside right side wall panel 42 are connected to the lid portion rear wall panel 14*a* along the fifth longitudinal score line 78 and the sixth longitudinal score line 80, respectively. The lid portion inside left side wall panel 40 is further defined in the longitudinal direction of the blank 30 by the separation between the angled third cut 66 and a seventh transverse score line 82, which is a substantially collinear extension of the sixth transverse score line 76. The lid portion inside right side wall panel 42 is defined in the longitudinal direction of the blank 30 by the separation between the angled fourth cut 70 and an eighth transverse score line 84, which is also a substantially collinear extension of the sixth transverse score line 76. To facilitate folding of the blank 30, the seventh transverse score line 82 and the eighth transverse score line 84 are also longitudinally offset relative to the sixth transverse score line 76, in the direction of the transverse hinge line 6, by a distance approximately equal to the thickness of the blank 30.

The lid portion top wall panel 18 extends longitudinally from the lid portion rear wall panel 14*a* at the sixth transverse score line 76 to a parallel ninth transverse score line 86. The lid portion top wall panel 18 is further defined in the lateral direction of the blank 30 by the separation between a longitudinal seventh cut 88 and a parallel longitudinal eighth cut 90, which extend between the sixth transverse score line 76 and the ninth transverse score line 86 and are perpendicular thereto, the longitudinal seventh cut 88 being a collinear extension of the fifth longitudinal score line 78 and the longitudinal eighth cut 90 being a collinear extension of the sixth longitudinal score line 80. The distance between the sixth transverse score line 76 and the ninth transverse score line 86 is the same as the separation between the second transverse score line 48 and the third transverse score line 54 so that the longitudinal extent of the lid portion top wall panel 18 is equal to that of the box portion bottom wall panel 16.

The lid portion left flap 44 is connected to the lid portion inside left side wall panel 40 along the seventh transverse score line 82 and extends in the longitudinal direction of the blank 30 from the seventh transverse score line 82 to a transverse ninth cut 92, which is a collinear extension of the ninth transverse score line 86. The lid portion right flap 46 is connected to the lid portion inside right side wall panel 42 along the eighth transverse score line 84 and extends in the longitudinal direction of the blank 30 from the eighth transverse score line 84 to a transverse tenth cut 94, which is also a collinear extension of the ninth transverse score line 86.

The lid front wall panel 8*a* extends longitudinally from the lid portion top wall panel 18 at the ninth transverse score line 86 to a parallel tenth transverse score line 24. The lid front wall panel 8*a* is further defined in the lateral direction of the blank 30 by the separation between a seventh longitudinal score line 96 and a parallel eighth longitudinal score line 98, which extend between the ninth transverse score line 86 and the tenth transverse score line 24 and are perpendicular thereto, the seventh longitudinal score line 96 being a collinear extension of the longitudinal seventh cut 88 and the eighth longitudinal score line 98 being a collinear extension of the longitudinal eighth cut 90. The distance between the ninth transverse score line 86 and the tenth transverse score line 24 is greater than the separation between the transverse hinge line 6 and the sixth transverse score line 76 so that the longitudinal extent of the lid portion front wall panel 8*a* is greater than that of the lid portion rear wall panel 14*a*.

The lid portion outside left side wall panel 10*a* and the lid portion outside right side wall panel 12*a*, which are of substantially the same shape and size as the lid portion inside left side wall panel 40 and the lid portion inside right side wall panel 42 respectively, are connected to the lid portion front wall panel 8*a* along the seventh longitudinal score line 96 and the eighth longitudinal score line 98, respectively. The lid portion flap 22, which is of substantially the same shape and size as the box portion flap 26, extends longitudinally from the lid portion front wall panel 8*a* at the tenth transverse score line 24.

To form the lower box portion 2 and upper lid portion of the hinge-lid container shown in FIG. 1 from the blank 30 shown in FIG. 2, the lid portion flap 22 is folded about the tenth transverse score line 24 so that it lies parallel and adjacent to the lid portion front wall panel 8*a*. The box portion flap 26 is similarly folded about the first transverse score line 28 so that it lies parallel and adjacent to the box portion front wall panel 8. Preferably, the box portion flap 26 and the lid portion flap 22 are adhesively attached to the box portion front wall panel 8 and the lid portion front wall panel 8*a*, respectively. To complete erection of the lower box portion 2 and upper lid portion of the hinge-lid container, the blank 30 is also folded in a known manner along the second to ninth transverse score lines 48, 54, 56, 58, 76, 82, 84 and 86, and along the eight longitudinal score lines 50, 52, 60, 62, 78, 80, 96 and 98.

Figure 3:
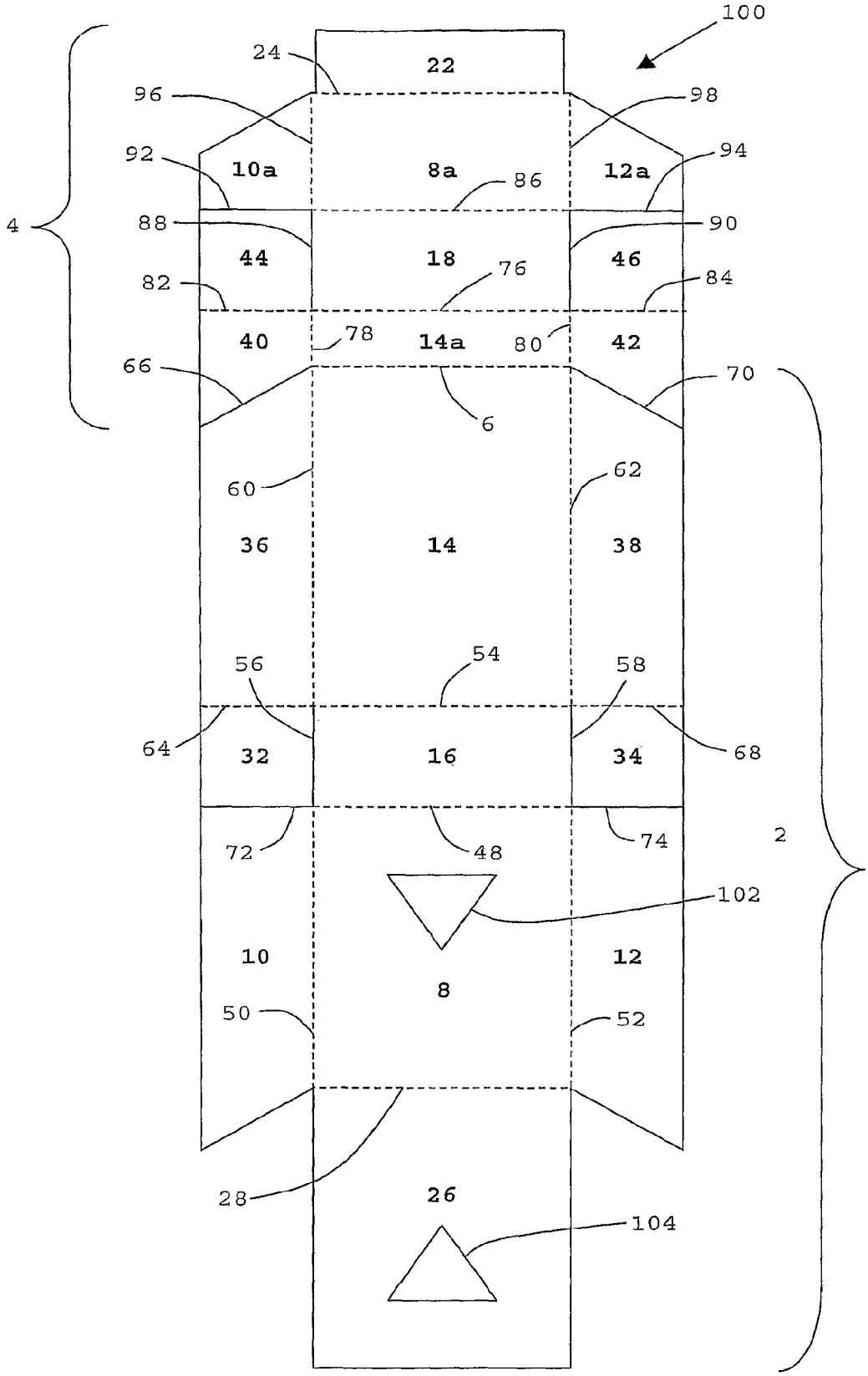
FIG. 3 is a plan view of the inner face of a laminar blank for forming a hinge-lid container according to a second embodiment of the invention.
Figure 4:
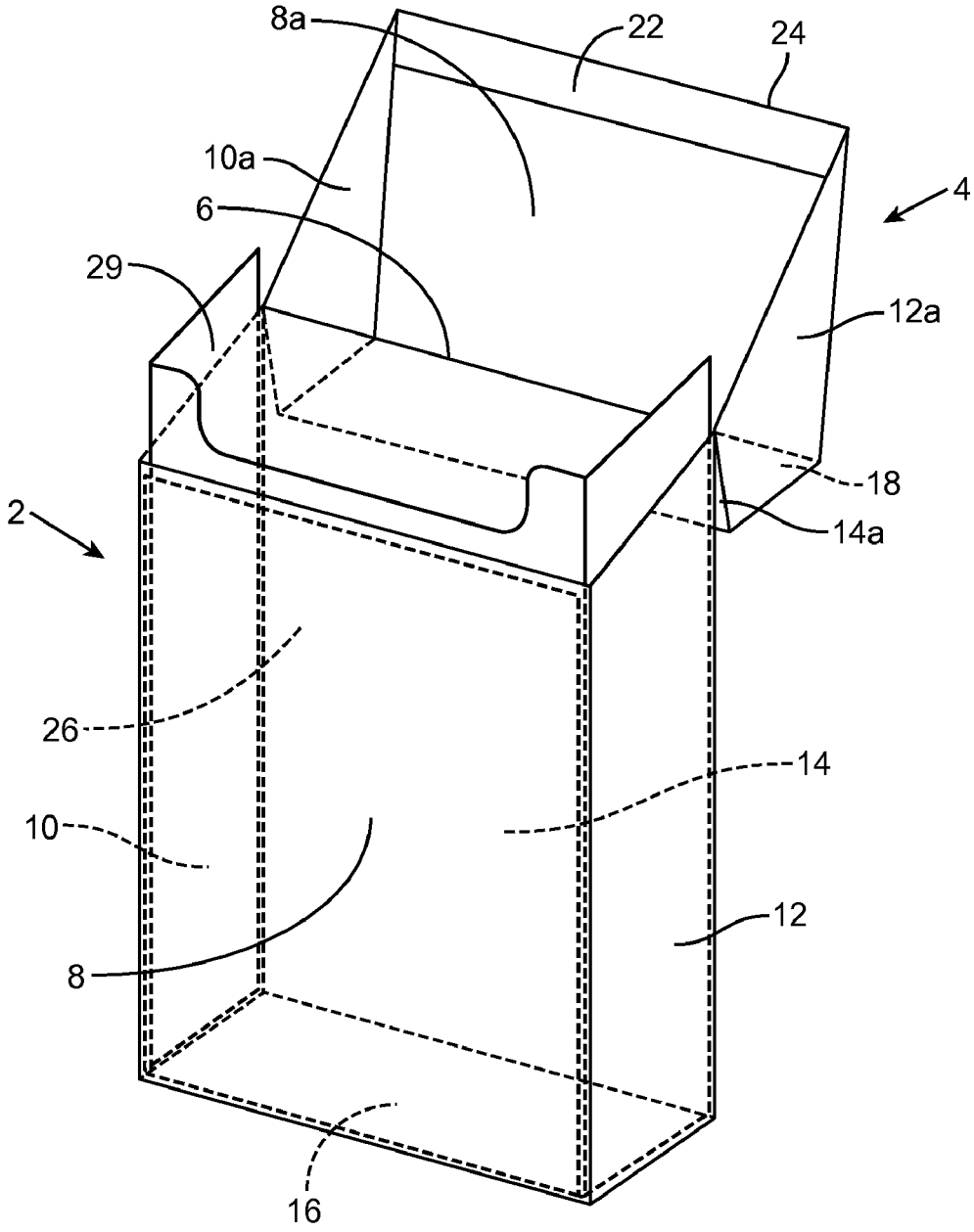
FIG. 4 is a plan view of the inner face of a laminar blank for an inner frame having an integral spacer panel.

FIG. 3 shows an elongate, laminar cardboard blank 100 for forming a hinge-lid container according to a second embodiment of the invention. The blank 100 shown in FIG. 3 is of largely similar construction to the blank 30 shown in FIG. 2 and the same reference numerals are used in FIG. 3 for elements of blank 100 corresponding to elements of the blank 30 of FIG. 2 previously described. In contrast to the blank 30 shown in FIG. 2, the box portion flap 26 of the blank 100 shown in FIG. 3 is of substantially the same size and shape as the box portion front wall panel 8. A first triangular opening 102 is provided in the front wall of the box portion front wall panel 8 proximate the second transverse score line 48. A second triangular opening 104, of substantially the same size as the first triangular opening 102 and aligned centrally therewith in the lateral direction of the blank 100, is provided in the box portion flap 26 distant from the first transverse score line 28. The remaining features of the blank 100 are identical to those of the blank 30 shown in FIG. 2.

A hinge-lid container according to a second embodiment of the invention is erected from the blank 100 of FIG. 3 by folding the blank 100 in the same manner previously described to erect the lower box portion 2 and upper lid portion of the container according to the first embodiment of the invention, shown in FIG. 1, from the blank 30 of FIG. 2. The relative orientation and position of the first triangular opening 102 and the second triangular opening 104 of the blank 100 of FIG. 3 are such that when the box portion flap 26 thereof is folded about the first transverse score line 28, so that it lies parallel and adjacent to the box portion front wall panel 8, the second triangular opening 104 in the box portion flap 26 is aligned with the first triangular opening 102 in the box portion front wall 8.

If desired, the hinge-lid container according to a second embodiment of the invention erected from the blank 100 shown in FIG. 2 may further comprise an inner frame of the type included in the hinge-lid container according to the first embodiment of the invention shown in FIG. 1.

Where the hinge-lid containers according to the first and second embodiments of the invention are to be used as hinge-lid cigarette packs, the folding of the blank 30 shown in FIG. 2 and the blank 100 shown in FIG. 3, respectively, may be carried out on conventional machinery for producing hinge-lid cigarette packs having an inner lid panel. For example, hinge-lid cigarette packs according to the first and second embodiments of the invention may be produced using the packers sold under model numbers X2, X3 and H1000 by G.D S.p.A. of Bologna, Italy and/or the packers sold under model numbers 350, 700, F5 and F8 by Focke & Co. (GmbH & Co.) of Verden, Germany, which have been modified to include an additional folding mechanism for folding the box portion flap 26 in, for example, the region where the inner lid panel 22 is folded.

While the invention has been discussed largely in terms of the packaging of elongate smoking articles such as cigarettes, it will be appreciated that hinge-lid containers according to the invention may also be used to package a variety of other items such as, for example, cosmetics, confectionery products and other foodstuffs.

Furthermore, while the invention has been exemplified above with reference to hinge-lid containers having right-angled edges, hinge-lid containers according to the invention may also include, for example, one or more rounded or beveled edges. By scoring in a known manner a laminar blank from which it is erected, a "rounded-corner" hinge-lid container according to the invention for housing a plurality of cigarettes or other elongate smoking articles may, for example, be produced.

The invention claimed is:

1. A hinge-lid container comprising:

a box portion;

a lid portion hinged to the box portion across a rear wall thereof for pivotal movement between an open position and a closed position;

a flap extending across a lower part of the inner surface of a front wall of the lid portion;

a spacer panel extending across at least an upper part of the inner surface of a front wall of the box portion, the spacer panel having a free edge that extends across the inner surface of the front wall of the box portion, wherein the spacer panel does not project from the box portion into space covered by the lid portion in the closed position;

an inner frame mounted in the box portion and projecting from the box portion into space covered by the lid portion in the closed position, the spacer panel being positioned between the inner surface of the front wall of the box portion and the inner frame; and wherein the spacer panel depends from and folds about a lower edge of a front wall of the inner frame.

2. A hinge-lid container according to claim 1 wherein the box portion, lid portion, and flap are formed from a one-piece folded laminar blank.

3. A hinge-lid container according to claim 1 wherein the flap depends from and is folded about the lower edge of the front wall of the lid portion.

4. A hinge-lid container according to claim 1 wherein the spacer panel extends across substantially the entire width of the inner surface of a front wall of the box portion.

5. A hinge-lid container according to claim 1 further comprising: a first opening extending through the front wall of the box portion; and a second opening extending through the spacer panel, at least a portion of the second opening being aligned with at least a portion of the first opening.

6. A hinge-lid container according to claim 1 wherein the spacer panel is of substantially the same dimensions as the front wall of the box portion.

7. A hinge-lid container according to claim 1 wherein the spacer panel is of substantially the same dimensions as the flap.

8. A hinge-lid container according to claim 1 wherein the spacer panel is affixed to the inner surface of the front wall of the box portion.

9. A hinge-lid container according to claim 1 containing a plurality of elongate smoking articles.

10. A hinge-lid container according to claim 1 containing a plurality of packs of elongate smoking articles.

11. A hinge-lid container according to claim 1 wherein the inner frame further includes a left side wall and a right side wall, and wherein a lower portion of each opposes a corresponding wall of the box portion.

12. A hinge-lid container according to claim 1, wherein the box portion, lid portion and flap are formed from a first, folded, one-piece laminar blank, and the inner frame and spacer panel are formed from a second, folded, one-piece laminar blank.

13. A hinge-lid container comprising:

a box portion;

a lid portion hinged to the box portion across a rear wall thereof for pivotal movement between an open position and a closed position;

a flap extending across a lower part of the inner surface of a front wall of the lid portion;

a spacer panel extending across at least an upper part of the inner surface of a front wall of the box portion, the spacer panel having a free edge that extends across the inner surface of the front wall of the box portion, wherein the spacer panel does not project from the box portion into space covered by the lid portion in the closed position, and the spacer panel is of substantially the same dimensions as the front wall of the box portion;

an inner frame mounted in the box portion and projecting from the box portion into space covered by the lid portion in the closed position, the spacer panel being positioned between the inner surface of the front wall of the box portion and the inner frame, and wherein the spacer panel depends from and folds about a lower edge of a front wall of the inner frame;

a first opening extending through the front wall of the box portion; and a second opening extending through the spacer panel, at least a portion of the second opening being aligned with at least a portion of the first opening.

14. A hinge-lid container according to claim 13 wherein the box portion, lid portion, and flap are formed from a one-piece folded laminar blank.

15. A hinge-lid container according to claim 13 containing a plurality of elongate smoking articles.

16. A hinge-lid container according to claim 13 wherein the inner frame further includes a left side wall and a right side wall, and wherein a lower portion of each opposes a corresponding wall of the box portion.

17. A hinge-lid container according to claim 13, wherein the box portion, lid portion and flap are formed from a first, folded, one-piece laminar blank, and the inner frame and spacer panel are formed from a second, folded, one-piece laminar blank.

* * * * *